US005186506A

United States Patent [19]

Gale

[11] Patent Number: 5,186,506

[45] Date of Patent: Feb. 16, 1993

[54] DEVICE FOR PICKING-UP AND REMOVING ANIMAL EXCREMENT

[76] Inventor: Edward L. Gale, 6615 Cowles Mountain Blvd., San Diego, Calif. 92119

[21] Appl. No.: 859,948

[22] Filed: Mar. 30, 1992

[51] Int. Cl.[5] ..... A01K 29/00

[52] U.S. Cl. ..... 294/1.3; 294/118

[58] Field of Search ..... 294/1.3, 1.4, 1.5, 8.5, 294/11, 3, 55, 55.5, 118; 209/417, 418; 15/104.8, 257.1, 257.6

[56] References Cited

U.S. PATENT DOCUMENTS

| | | | |
|---|---|---|---|
| 818,465 | 4/1906 | Price | 294/118 X |
| 1,903,277 | 4/1933 | Barnes | 294/55 X |
| 3,560,039 | 2/1971 | Gruber | 294/118 X |
| 3,813,121 | 5/1974 | Marvin | 294/1.3 |
| 3,964,775 | 6/1976 | Boyd | 294/118 X |
| 4,148,510 | 4/1979 | Brack et al. | 294/1.3 |
| 4,179,145 | 12/1979 | Shinsako | 294/1.4 |
| 4,875,729 | 10/1989 | Peck | 294/1.3 |
| 5,076,627 | 12/1991 | Simon | 294/1.3 |

FOREIGN PATENT DOCUMENTS

| | | | |
|---|---|---|---|
| 361117 | 4/1990 | European Pat. Off. | 294/1.3 |
| 8004310 | 3/1982 | Netherlands | 294/1.3 |
| 2115737 | 9/1983 | United Kingdom | 294/1.3 |

*Primary Examiner*—Charles A. Marmor
*Assistant Examiner*—Dean J. Kramer
*Attorney, Agent, or Firm*—Charles C. Logan, II

[57] ABSTRACT

A device for picking-up and removing animal excrement and the like has a pair of elongated tong members pivotally connected together intermediate their ends. Each of the tong members have a loop handle portion at its rear end, an intermediate shank portion and a jaw portion at its front end. The device is used with or without a conventional plastic bag. The jaw portions of the tongs are inserted into the open end of the plastic bag and the jaw portions are then pivoted away from each until they contact the sides of the plastic bag. The end of the plastic bag is then pushed into the space between the jaw portions to form a chamber for receiving animal excrement. The front end of the jaw portions is then positioned over the animal excrement and the jaw portions are pivoted to a closed position in which the respective side walls of the top jaw member and the respective side walls of the bottom jaw portion are interlocked together so that the plastic bag can be captured between them. The open end of the plastic bag is then pulled toward the front end of the jaw portions and it is tightly closed. The closed plastic bag is then removed from the jaw portions of the device and thrown away.

2 Claims, 1 Drawing Sheet

DEVICE FOR PICKING-UP AND REMOVING ANIMAL EXCREMENT

BACKGROUND OF THE INVENTION

The present invention relates to a new and improved device for picking-up and removing animal excrement.

One of the most troublesome problems that dog owners have is how to pick up their dogs' excrement. Some cities have ordinances that require the owner of an animal to pick-up its waste. Also public pressure requires the dog owner to be more considerate of others by requiring them to clean-up the dog mess.

There are several present state of the art devices used for picking-up animal excrement. The Gruber U.S. Pat. No. 3,560,039 discloses a sanitation device having a pair of scooped portions that are used to pick-up the animal excrement and it also has a tissue-retaining device mounted thereon. A tissue is removed from the tissue-retaining device and draped over the excrement. Then the tong members are acuated to pick-up the tissue and excrement.

The Fleishman U.S. Pat. No. 3,841,684 and the Stacy U.S. Pat. No. 4,747,633 are directed to disposable tongs and scoops that are used to pick-up animal excrement. Other structures for picking-up animal litter are illustrated in Kjaer U.S. Pat. No. 4,273,370, Watanabe U.S. Pat. No. 4,830,419 and Beck U.S. Pat. No. 4,900,077.

It is an object of the invention to provide a novel device for picking-up and removing animal excrement that can be operated using only one hand.

It is also an object of the invention to provide a novel device, for picking-up and removing animal excrement, that is portable, easy to use, carry and store.

It is another object of the invention to provide a novel device for picking-up and removing animal excrement that is sanitary since the material being picked up does not contact flesh or the device itself.

It is another object of the invention to provide a novel device for picking-up and removing animal excrement that uses disposable new or recycled plastic bags.

It is an additional object of the invention to provide a novel device for picking-up and removing animal excrement that can be used without the plastic bag when cleaning a cat sand box.

It is a further object of the invention to provide a novel device for picking-up and removing animal excrement that is economical to manufacture and market.

SUMMARY OF THE INVENTION

The novel device for picking-up and removing animal excrement has been designed to capture the material without it touching flesh or the device. The bag within which it is received is easily disposed of into a trash container. The device can be operated using only one hand. Its weight and size are minimal and it can be used by adults or children.

The device would preferably be made of a tough plastic such as ABS or the equivalent. It could be made of a minimum of two or three parts, depending upon whether the hinge pin is integrally formed on one of the tong members.

The novel device is made from a pair of elongated tong members that are pivotally connected together intermediate their ends. Each of the tong members have a loop handle portion, a shank portion and a jaw portion. The top jaw portion has a front edge, a top wall, left and right side walls and a rear wall. The bottom jaw portion has a front edge, a bottom wall, left and right side walls and a rear wall. Both the top and bottom jaw portions may have elongated slots that would allow the device to be used for removing cat liter from a cat box.

A preferred manner of using the novel device requires a plastic bag having an open end into which the jaw portions are inserted. Next the jaw portions are opened until they touch the inside wall surfaces of the plastic bag. The front closed end of the bag is then pushed inwardly between the respective jaw portions to form a chamber. By placing the device over the animal excrement and closing the handles toward each other, the excrement is captured within the interior of the plastic bag. The top and bottom jaw portions have interlocking structure on their rear and side walls that allow them to tightly grip the bag when the jaws are closed. Next the open end of the bag is pulled forwardly and reversed upon itself and a drawstring is tightened to close the bag. If there is a convenient trash container available the used plastic bag can be removed from the jaws of the device. If a trash container is not convenient the jaws of the device are kept tightly closed by wrapping the drawstring around the jaws until the bag can be disposed of.

DESCRIPTION OF THE PREFERRED EMBODIMENT

Figure 1:
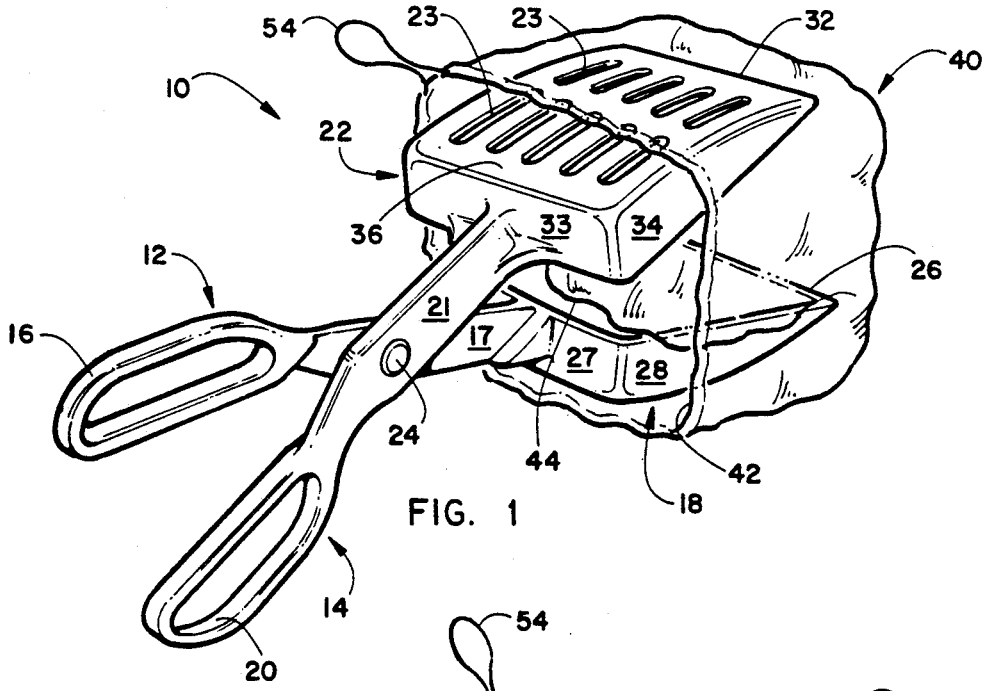
FIG. 1 is a rear perspective view illustrating the novel device for picking-up and removing animal excrement showing it inserted into the open end of a plastic bag.
Figure 2:
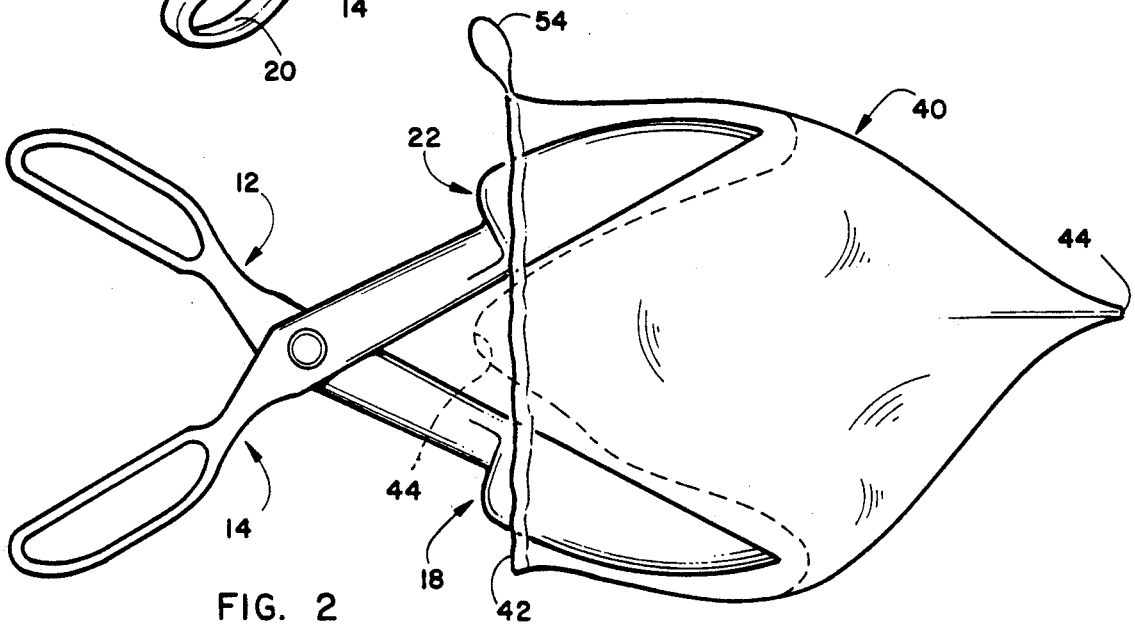
FIG. 2 is a side elevation view of FIG. 1 show the closed end of the bag prior to it being pushed inwardly toward the interior of the top and bottom jaw portions.

The novel device for picking-up and removing animal excrement will now be described by referring to FIGS. 1–3 of the drawing.

The device is generally designated numeral 10. Device 10 is formed from a pair of elongated tong members 12 and 14. Tong member 12 has a loop handle portion 16, a shank portion 17 and a bottom jaw portion 18. Tong member 14 has a loop handle portion 20, a shank portion 21 and a top jaw portion 22. Element 24 may be a pin that passes through aligned apertures in shank portion 17 and 21. An alternative structure would have element 24 being a boss member that is integrally formed on shank portion 17 and it would be journaled in an aperture in shank portion 21. The jaw portions 18 and 22 may have a plurality of elongated slots 23.

Bottom jaw portion 18 has a front edge 26, a rear wall 27, side walls 28 and 29, and a bottom wall 30.

Top jaw portion 22 has a front edge 32, a rear wall 33, left and right side walls 34, and 35 and a top wall 36.

Plastic bag 40 has an open end 42 and a closed end 44. After the jaw portions 18 and 22 have been inserted in open end 42, closed end 44 is pushed inwardly to the dotted position shown in FIG. 2. At this point the device is ready to be used for picking-up and removing animal excrement.

Figure 3:
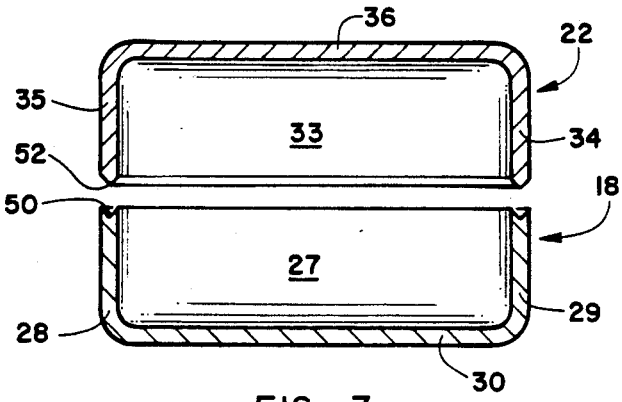
FIG. 3 is a cross sectional view taken through the respective top and bottom jaw portions to show the manner in which the plastic bag is gripped between the two members when the jaws are closed.

In FIG. 3 a cross sectional view shows bottom jaw portion 18 and top jaw portion 22 immediately before they are closed into an interlocking position. Side walls 28 and 29 and rear wall 27 have V-shaped grooves extending longitudinally along their top edge. Side walls 34 and 35 and rear wall 33 have a pointed ridge 52 extending longitudinally along their respective bottom edges. When these ridges and V-shaped grooves are pressed together, they firmly and positively hold the plastic bag while the open end of the bag is drawn forwardly or in a reversed upon itself direction as it is being removed from the jaw portions of the device. Once the open end is positioned forwardly, drawstring 54 would be pulled in order to close the end of the plastic bag with the excrement inside. The closed plastic bag would then be ready to be discarded into a trash container.

What is claimed is:

1. A device for picking-up and removing animal excrement and the like comprising:

a pair of elongated tong members each having a front end and a rear end;

means pivotally connecting together said tong members intermediate their ends;

each of said tong members having a loop handle portion at its rear end, an intermediate shank portion and a jaw portion at its front end;

one of said jaw portions being designated a top jaw portion and said other jaw portion being designated a bottom jaw portion;

said top jaw portion having a front edge, a top wall, left and right side walls, and a rear wall that extends transversely to its intermediate shank portion, said left and right side walls having their greatest height where they join said rear wall and their height becomes progressively smaller as they approach the front edge of said top wall where there is no height to said left and right side walls;

said bottom jaw portion having a front edge, a bottom wall, left and right side walls, and a rear wall that extends transversely to its intermediate shank portion, said left and right side walls having their greatest height where they join said rear wall and their height becomes progressively smaller as they approach the front edge of said bottom wall where there is no height to said left and right side walls;

the lateral distance between the respective left and right side walls of said top jaw portion and said bottom jaw portion being substantially the same so that they align with each other when closed together;

the left and right side walls and the rear wall of said bottom jaw portion each having a top edge having a groove extending longitudinally along its length;

the left and right side walls and the rear wall of said top jaw portion each having a bottom edge having a ridge extending longitudinally along its length; and said respective ridges and grooves providing structure for being detachably interlocking together so that a plastic bag can be gripped between them.

2. The device recited in claim 1 in combination with a conventional plastic bag having an open end and a closed end; the jaw portions of said tongs being inserted into the open end of said plastic bag and said jaw portions being pivoted away from each other until they contact the sides of said plastic bag and the closed end of said plastic bag is then pushed into the space between said jaw portions to form a chamber for receiving animal excrement.

* * * * *